US008531388B2

(12) United States Patent
Lee et al.

(10) Patent No.: US 8,531,388 B2
(45) Date of Patent: Sep. 10, 2013

(54) LIQUID CRYSTAL DISPLAY AND METHOD FOR DRIVING THE SAME

(75) Inventors: Sunhwa Lee, Paju-si (KR); Kiduk Kim, Paju-si (KR); Daeheung Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 412 days.

(21) Appl. No.: 12/831,100

(22) Filed: Jul. 6, 2010

(65) Prior Publication Data

US 2011/0157111 A1 Jun. 30, 2011

(30) Foreign Application Priority Data

Dec. 30, 2009 (KR) ..... 10-2009-0134647

(51) Int. Cl.
*G09G 3/36* (2006.01)

(52) U.S. Cl.
USPC ..... 345/103; 345/102

(58) Field of Classification Search
USPC ..... 345/98–100, 102, 103
See application file for complete search history.

(56) References Cited

U.S. PATENT DOCUMENTS

| | | | | |
|---|---|---|---|---|
| 2006/0038771 | A1* | 2/2006 | Hirakata et al. | 345/102 |
| 2006/0238486 | A1* | 10/2006 | Hiraki | 345/102 |
| 2008/0013126 | A1* | 1/2008 | Tseng et al. | 358/3.01 |
| 2010/0164922 | A1* | 7/2010 | Nose et al. | 345/690 |

FOREIGN PATENT DOCUMENTS

| | | | |
|---|---|---|---|
| JP | 2003-271111 | A | 9/2003 |
| JP | 2009-175740 | A | 8/2009 |
| JP | 2009-237352 | A | 10/2009 |
| KR | 10-2009-0038821 | A | 4/2009 |

* cited by examiner

*Primary Examiner* — Allison Walthall
(74) *Attorney, Agent, or Firm* — Birch, Stewart, Kolasch & Birch, LLP

(57) ABSTRACT

A liquid crystal display includes a liquid crystal display panel, a data driving circuit, a gate driving circuit, a plurality of light sources, a light source control circuit configured to differently modulate a unit frame data depending on a display location of the unit frame data on the liquid crystal display panel and to control turn-on and turn-off operations of the light sources, a timing controller configured to divide a unit frame period into first and second sub-frame periods and to repeatedly supply the modulated unit frame data to the data driving circuit during the first and second sub-frame periods, and a light source driving circuit configured to turn off all the light sources during the first sub-frame period and turn on all the light sources at a turn-on time within the second sub-frame period.

10 Claims, 10 Drawing Sheets

(A)

(B)

LIQUID CRYSTAL DISPLAY AND METHOD FOR DRIVING THE SAME

This application claims the benefit of Korea Patent Application No. 10-2009-0134647 filed on Dec. 30, 2009, which is incorporated herein by reference for all purposes as if fully set forth herein.

BACKGROUND OF THE INVENTION

1. Field of the Invention

Embodiments of the invention relate to a liquid crystal display and a method for driving the same capable of improving a motion picture response time (MPRT) performance.

2. Discussion of the Related Art

An active matrix type liquid crystal display displays a motion picture using a thin film transistor (TFT) as a switching element. The active matrix type liquid crystal display has been implemented in televisions as well as display devices in portable information devices, office equipment, computers, etc., because of its thin profile and high definition. Accordingly, cathode ray tubes are being rapidly replaced by the active matrix type liquid crystal displays.

When a liquid crystal display displays a motion picture, a motion blur resulting in an unclear and blurry screen may appear because of the characteristics of liquid crystals. A scanning backlight driving technology was proposed so as to improve a motion picture response time (MPRT) performance. As shown in FIGS. 1 and 2, the scanning backlight driving technology provides an effect similar to an impulsive drive of a cathode ray tube by sequentially turning on and off a plurality of light sources of a backlight unit along a scanning direction of display lines of a liquid crystal display panel and thus can solve the motion blur of the liquid crystal display. In FIGS. 1 and 2, the black regions show the portions where the light sources are off and the white regions show the portions where the light sources are on. However, the scanning backlight driving technology has the following problems.

First, because the light sources of the backlight unit are turned off for a predetermined time in each frame period in the scanning backlight driving technology, the screen becomes dark. As a solution thereto, a method for controlling the turn-off time of the light sources depending on the brightness of the screen may be considered. However, in this case, the improvement effect of the MPRT performance is reduced because the turn-off time is shortened or removed in the bright screen.

Second, light interference occurs in boundary portions of the scanning blocks because turn-on times or turn-off times of the light sources of the scanning blocks are different from one another in the scanning backlight driving technology.

Third, the formation location of the light sources of the backlight unit are limited because the scanning backlight driving technology can be successfully implemented by controlling light incident on the liquid crystal display panel in each of the scanning blocks. The backlight unit may be classified into a direct type backlight unit and an edge type backlight unit.

In the direct type backlight unit, a plurality of optical sheets and a diffusion plate are stacked under the liquid crystal display panel, and a plurality of light sources are positioned under the diffusion plate. Thus, it is easy to achieve the scanning backlight driving technology in the direct type backlight unit having the above-described structure.

On the other hand, in the edge type backlight unit, a plurality of light sources are positioned opposite the side of a light guide plate, and a plurality of optical sheets are positioned between the liquid crystal display panel and the light guide plate. In the edge type backlight unit, the light sources irradiate light onto one side of the light guide plate and the light guide plate has a structure capable of converting a line light source (or a point light source) into a surface light source. In other words, the characteristics of the light guide plate are such that the light irradiated onto one side of the light guide plate spreads on all sides of the light guide plate. Therefore, it is difficult to control light incident on the liquid crystal display panel in each of the display blocks and hence, it is difficult to achieve the scanning backlight driving technology in the edge type backlight unit having the above-described structure.

SUMMARY OF THE INVENTION

Accordingly, the invention is directed to a liquid crystal display and a method for driving the same that substantially obviate one or more problems due to limitations and disadvantages of the related art.

Embodiments of the invention provide a liquid crystal display and a method for driving the same capable of improving a motion picture response time (MPRT) performance without light interference resulting from a difference between turn-on times or turn-off times of light sources.

Embodiments of the invention also provide a liquid crystal display and a method for driving the same capable of improving a MPRT performance irrespective of locations of light sources constituting a backlight unit without a reduction in a luminance of the liquid crystal display.

In one aspect, there is a liquid crystal display including a liquid crystal display panel including data lines and gate lines, a data driving circuit configured to drive the data lines, a gate driving circuit configured to drive the gate lines, a plurality of light sources configured to provide light to the liquid crystal display panel, a light source control circuit configured to differently modulate a unit frame data depending on a display location of the unit frame data on the liquid crystal display panel and to control turn-on and turn-off operations of the plurality of light sources, a timing controller configured to divide a unit frame period into a first sub-frame period and a second sub-frame period and to repeatedly supply the modulated unit frame data to the data driving circuit during the first and second sub-frame periods, and a light source driving circuit configured to turn off all the plurality of light sources during the first sub-frame period and turn on all the plurality of light sources at a turn-on time within the second sub-frame period.

The timing controller multiplies a unit frame frequency by N and controls an operation timing of the data driving circuit and an operation timing of the gate driving circuit using a sub-frame frequency of (unit frame frequency×N), where N is a positive integer equal to or greater than 2.

The light source control circuit generates a pulse width modulation (PWM) signal for controlling the turn-on and turn-off operations of the light sources and a current control signal for controlling a driving current applied to the light sources.

The light source control circuit includes a data modulation unit configured to modulate the unit frame data and to vary a modulation width of the unit frame data depending on the display location of the unit frame data on the liquid crystal display panel.

The data modulation unit divides the liquid crystal display panel in a plurality of blocks along a longitudinal direction and increases the modulation width of the unit frame data as a distance between the display location of the unit frame data on the liquid crystal display panel and a middle block of the plurality of blocks increases.

When an upper block and a lower block of the plurality of blocks are spaced apart from the middle block by the same distance, the data modulation unit allows a modulation width of the unit frame data in the upper block and a modulation width of the unit frame data in the lower block to be equal each other.

The data modulation unit includes a first lookup table configured to modulate the modulation width of the unit frame data to be displayed on the middle block into a first modulation width, a second lookup table configured to modulate the modulation width of the unit frame data to be displayed on each of a first upper block and a first lower block, that are spaced apart from the middle block by a first distance, into a second modulation width greater than the first modulation width, and a third lookup table configured to modulate the modulation width of the unit frame data to be displayed on each of a second upper block and a second lower block, that are spaced apart from the middle block by a second distance longer than the first distance, into a third modulation width greater than the second modulation width.

The data modulation unit includes a lookup table configured to modulate the modulation width of the unit frame data to be displayed on the middle block into a first modulation width, a first adding unit configured to add an output of the lookup table to a first weight value so as to modulate the modulation width of the unit frame data to be displayed on each of a first upper block and a first lower block, that are spaced apart from the middle block by a first distance, into a second modulation width greater than the first modulation width, and a second adding unit configured to add the output of the lookup table to a second weight value greater than the first weight value so as to modulate the modulation width of the unit frame data to be displayed on each of a second upper block and a second lower block, that are spaced apart from the middle block by a second distance longer than the first distance, into a third modulation width greater than the second modulation width.

The light source control circuit includes a gain value calculation unit configured to analyze the unit frame data to obtain a frame representative value and to calculate a gain value based on the frame representative value and a duty adjusting unit configured to adjust a duty ratio of the PWM signal depending on the gain value. The duty ratio of the PWM signal is adjusted to be proportional to the gain value within a range equal to or less than a previously set maximum duty ratio.

A level of the driving current is previously set to be inversely proportional to a maximum duty ratio of the PWM signal.

The frame representative value is calculated based on an entire screen of the liquid crystal display panel or based on each block of the liquid crystal display panel smaller than the entire screen. The duty ratio of the PWM signal is adjusted based on the entire screen of the liquid crystal display panel or based on each block of the liquid crystal display panel smaller than the entire screen.

The turn-on time of the light sources is determined within the second sub-frame period after all of liquid crystals of the liquid crystal display panel are saturated.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
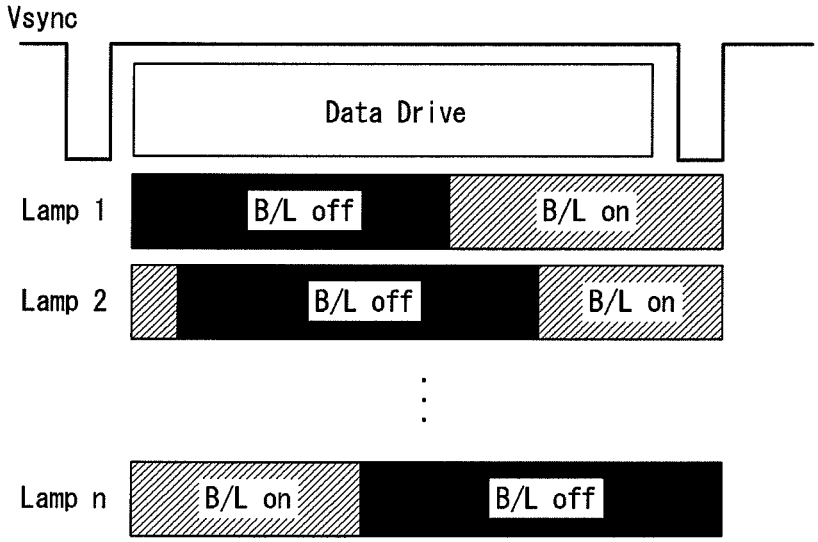
FIG. 1 (RELATED ART)
FIGS. 1 and 2 illustrate a related art scanning backlight driving technology.
Figure 2:
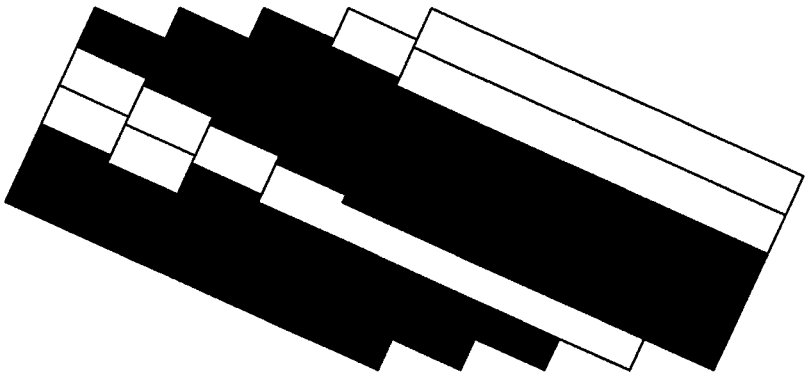
FIG. 2 (RELATED ART)
Figure 3:
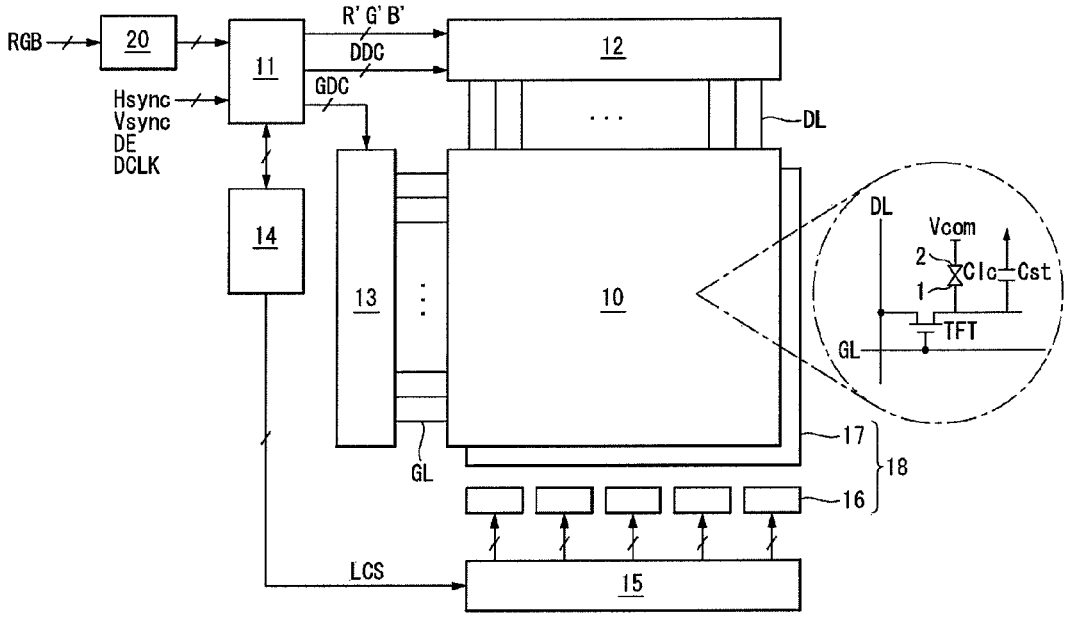
FIG. 3 illustrates a liquid crystal display according to an exemplary embodiment of the invention.

FIG. 3 illustrates a liquid crystal display according to an exemplary embodiment of the invention. As shown in FIG. 3, a liquid crystal display according to an exemplary embodiment of the invention includes a liquid crystal display panel 10, a data driving circuit 12 for driving data lines DL of the liquid crystal display panel 10, a gate driving circuit 13 for driving gate lines GL of the liquid crystal display panel 10, a timing controller 11 for controlling the data driving circuit 12 and the gate driving circuit 13, a frequency modulation circuit 20, a backlight unit 18 including a plurality of light sources 16 and providing light to the liquid crystal display panel 10, a light source control circuit 14 generating a light source control signal LCS, and a light source driving circuit 15 for driving the plurality of light sources 16 in response to the light source control signal LCS, wherein the light source driving circuit 15 is capable of turning on and off all of the light sources 16 in a blinking manner.

The liquid crystal display panel 10 includes an upper glass substrate (not shown), a lower glass substrate (not shown), and a liquid crystal layer (not shown) between the upper and lower glass substrates. The plurality of data lines DL and the plurality of gate lines GL cross one another on the lower glass substrate of the liquid crystal display panel 10. A plurality of liquid crystal cells Clc are arranged on the liquid crystal display panel 10 in a matrix form in accordance with the data lines DL and the gate lines GL crossing each other. Thin film transistors TFT, pixel electrodes 1 of the liquid crystal cells Clc connected to the thin film transistors TFT, storage capacitors Cst are formed on the lower glass substrate of the liquid crystal display panel 10.

A black matrix (not shown), a color filter (not shown), and a common electrode 2 are formed on the upper glass substrate of the liquid crystal display panel 10. The common electrode 2 can be formed on the upper glass substrate in a vertical electric field driving manner, such as a twisted nematic (TN)

mode and a vertical alignment (VA) mode. The common electrode 2 and the pixel electrode 1 can be formed on the lower glass substrate in a horizontal electric field driving manner, such as an in-plane switching (IPS) mode and a fringe field switching (FFS) mode. Polarizing plates (not shown) are respectively attached to the upper and lower glass substrates of the liquid crystal display panel 10. Alignment layers (not shown) for setting a pre-tilt angle of liquid crystals are respectively formed the inner surfaces of the upper and lower glass substrates contacting the liquid crystals.

The timing controller 11 receives timing signals Vsync, Hsync, DE, and DCLK from an external system board (not shown) to generate a data control signal DDC and a gate control signal GDC for respectively controlling operation timings of the data driving circuit 12 and the gate driving circuit 13 based on the timing signals Vsync, Hsync, DE, and DCLK. The timing controller 11 multiplies the data control signal DDC and the gate control signal GDC to control operations of the data driving circuit 12 and the gate driving circuit 13 using a sub-frame frequency of (unit frame frequency×N) Hz, where N is a positive integer equal to or greater than 2. In particular, N is the number of sub-frames. For example, the sub-frame frequency is 240 Hz when the unit frame frequency is 120 Hz and N is 2.

The timing controller 11 divides a unit frame period into a first sub-frame period and a second sub-frame period. The timing controller 11 supplies unit frame data RGB received from the frequency modulation circuit 20 to the light source control circuit 14 and copies modulation data R'G'B' received from the light source control circuit 14 in each unit frame period using a frame memory. Then, the timing controller 11 synchronizes the original unit frame data RGB and the copied modulation data R'G'B' with the sub-frame frequency of (unit frame frequency×N) Hz to repeatedly supply the same modulation data R'G'B' to the data driving circuit 12 during the first and second sub-frame periods. In other words, the original unit frame data RGB is displayed on the screen during the first sub-frame period of the unit frame period, and the copied unit frame data R'G'B' is displayed on the screen during the second sub-frame period of the unit frame period.

The data driving circuit 12 includes a plurality of data driver integrated circuits (ICs). Each of the data driver ICs includes a shift register for sampling a clock, a register for temporarily storing the modulation data R'G'B', a latch that stores the modulation data R'G'B' corresponding to each line in response to the clock received from the shift register and simultaneously outputs the modulation data R'G'B' each corresponding to one line, a digital-to-analog converter (DAC) for selecting a positive or negative gamma voltage based on a gamma reference voltage corresponding to the digital data received from the latch, a multiplexer for selecting the data line DL receiving analog data converted from the positive/negative gamma voltage, an output buffer connected between the multiplexer and the data lines DL, and the like.

The data driving circuit 12 latches the modulation data R'G'B' under the control of the timing controller 11 and converts the latched modulation data R'G'B' into a positive or negative analog data voltage using a positive or negative gamma compensation voltage. The data driving circuit 12 then supplies the positive/negative analog data voltage to the data lines DL.

The gate driving circuit 13 includes a plurality of gate driver ICs. Each of the gate driver ICs includes a shift register, a level shifter for converting an output signal of the shift register into a swing width suitable for a TFT drive of the liquid crystal cells, an output buffer, and the like. The gate driving circuit 13 sequentially outputs a gate pulse (or a scan pulse) under the control of the timing controller 11 to supply the gate pulse to the gate lines GL. The above operation of the gate driving circuit 13 is performed in each of the first sub-frame period and the second sub-frame period.

The backlight unit 18 may be implemented as one of an edge type backlight unit and a direct type backlight unit. Because the exemplary embodiment of the invention drives the light sources in the blinking manner so as to improve a motion picture response time (MPRT) performance, the formation location of the light sources constituting the backlight unit are not limited. Although FIG. 3 shows an edge type backlight unit, the embodiment of the invention is not limited to the edge type backlight unit and may use any known backlight unit. The edge type backlight unit 18 includes a light guide plate 17, the plurality of light sources 16 irradiating light onto the side of the light guide plate 17, and a plurality of optical sheets stacked (not shown) between the light guide plate 17 and the liquid crystal display panel 10.

Figure 4A:
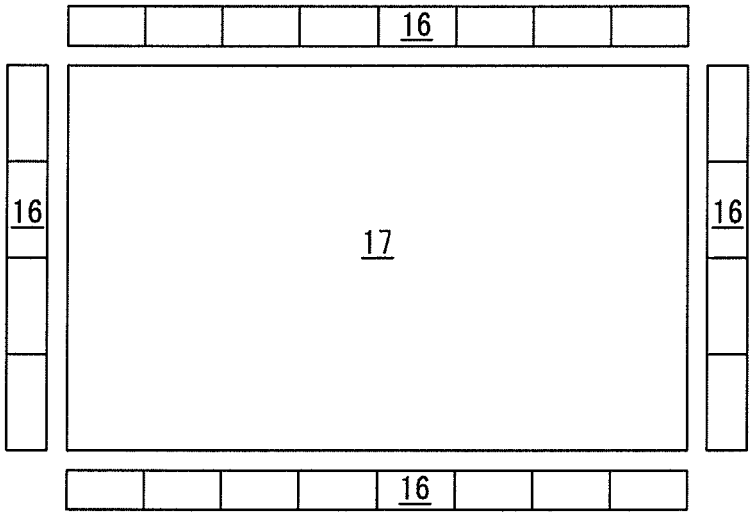
FIGS. 4A to 4D illustrate locations of light sources of a backlight unit according to the exemplary embodiment of the invention.
Figure 4B:
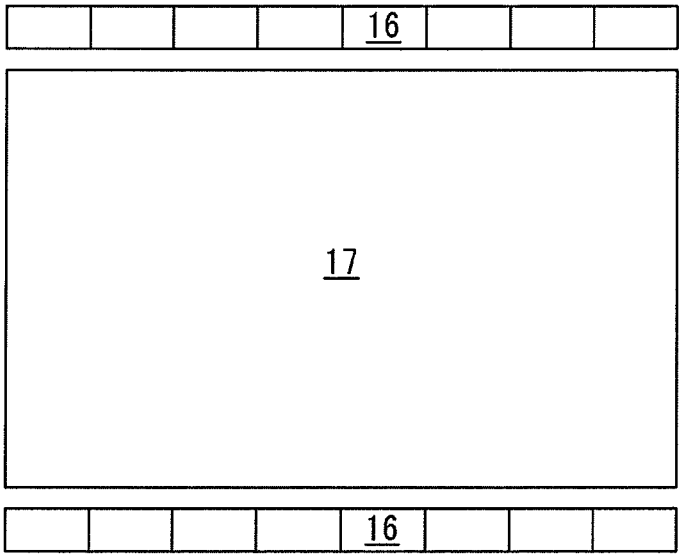
Figure 4C:
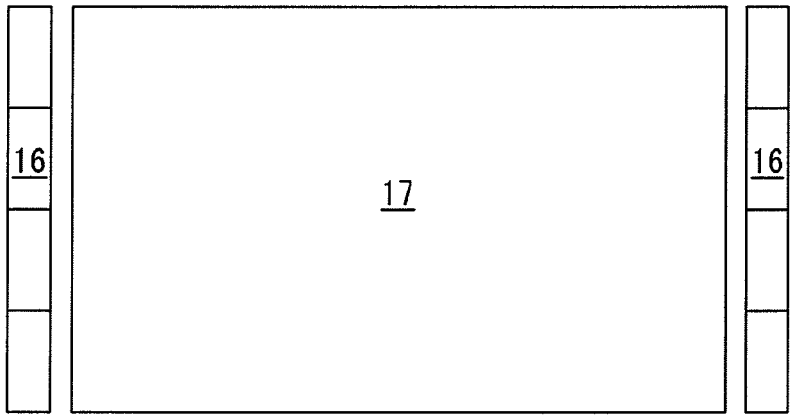
Figure 4D:
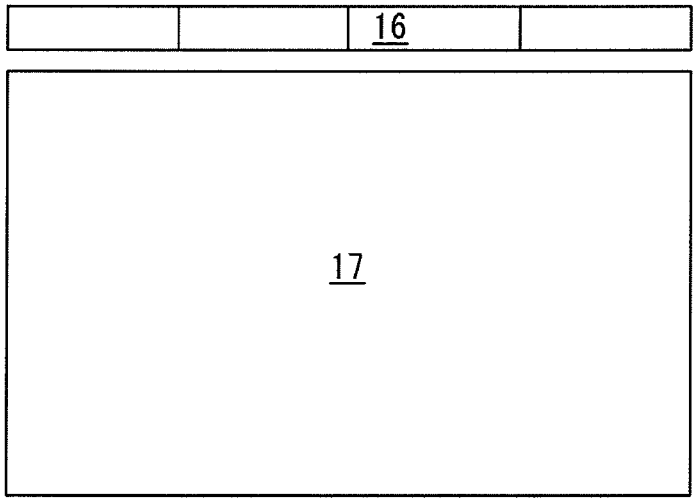

In the edge type backlight unit according to the exemplary embodiment of the invention, the light sources 16 may be positioned at at least one side of the light guide plate 17. For example, the light sources 16 may be positioned at four sides of the light guide plate 17 as shown in FIG. 4A or may be positioned at upper and lower sides of the light guide plate 17 as shown in FIG. 4B. Alternatively, the light sources 16 may be positioned at right and left sides of the light guide plate 17 as shown in FIG. 4C or may be positioned at one side of the light guide plate 17 as shown in FIG. 4D. The light sources 16 may be implemented as one of a cold cathode fluorescent lamp (CCFL), an external electrode fluorescent lamp (EEFL), and a light emitting diode (LED). Preferably, the light sources 16 may be implemented as the LED whose a luminance immediately varies depending on an adjustment of a driving current. The light guide plate 17 may have at least one of various types of patterns including a plurality of depressed patterns or embossed patterns, prism patterns, and lenticular patterns, and the at least one of the various types of patterns is formed on an upper surface and/or a lower surface of the light guide plate 17. The patterns of the light guide plate 17 may secure rectilinear propagation of a light path and may control a brightness of the backlight unit 18 in each local area. The optical sheets include at least one prism sheet and at least one diffusion sheet to diffuse light from the light guide plate 17 and to refract a travel path of light at substantially right angles to a light incident surface of the liquid crystal display panel 10. The optical sheets may include a dual brightness enhancement film (DBEF).

Figure 12:
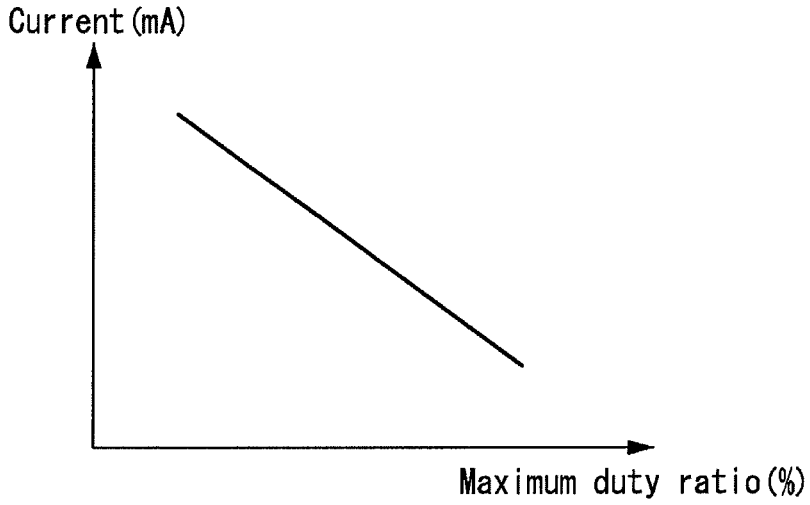

The light source control circuit 14 generates the light source control signal LCS including a pulse width modulation (PWM) signal for controlling turn-on time of the light sources 16 and a current control signal for controlling a driving current of the light sources 16. A maximum duty ratio of the PWM signal may be previously set within a range equal to or less than 50%, so that the MPRT performance can be improved. A level of the driving current of the light sources 16 may be previously set using the current control signal, so that the level of the driving current is inversely proportional to the maximum duty ratio of the PWM signal. More specifically, as shown in FIG. 12, as the maximum duty ratio of the PWM signal decreases, the level of the driving current increases. The inversely proportional relationship between the maximum duty ratio of the PWM signal and the level of the driving current is to compensate for a reduction in a luminance of the screen resulting from an increase in turn-off time of the light sources 16 in the unit frame period for improving the MPRT performance. A duty ratio of the PWM signal may vary depending on an input image within a range equal to or less than the previously set maximum duty ratio. In this case, the light source control circuit 14 adjusts the duty ratio of the PWM signal within the range of the maximum duty ratio based on the result of an analysis of the unit frame data RGB, thereby performing global dimming or local dimming. The light source control circuit 14 may differently modulate the unit frame data RGB depending on a display location on the liquid crystal display panel 10 so as to improve uniformity of the MPRT performance. The light source control circuit 14 may be mounted inside the timing controller 11.

The light source driving circuit 15 turns off all of the light sources 16 during the first sub-frame period and turns on all of the light sources 16 at the turn-on time within the second sub-frame period in response to the light source control signal LCS, thereby driving the light sources 16 in the blinking manner.

The frequency modulation circuit 20 is configured to upward modulate the unit frame frequency to prevent flickering in the blinking manner. In particular, the frequency modulation circuit 20 inserts interpolation frame into image frame provided from a video source to generate a unit frame data. For example, the frequency modulation circuit 20 can modulate image frame data with a frequency of 60 Hz into a unit frame data with a frame frequency of 120 Hz by inserting one interpolation frame for each image frame.

Figure 5:
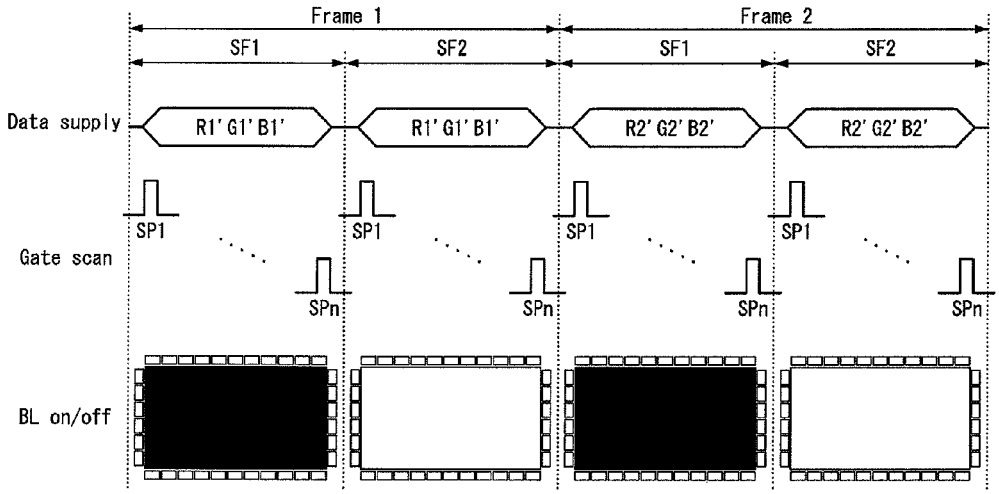
FIG. 5 illustrates data write and turn-on times and turn-off times of light sources for improving a motion picture response time (MPRT) performance according to the exemplary embodiment of the invention.
Figure 6:
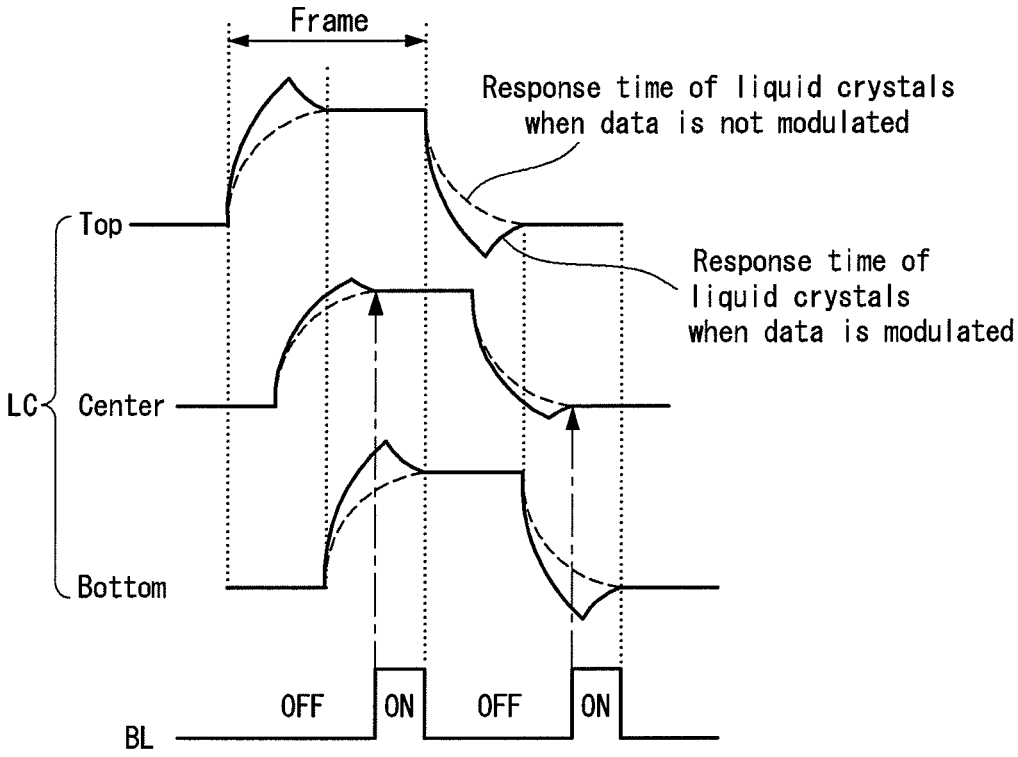
FIG. 6 illustrates a result of varying a modulation width of data depending on a display location on a liquid crystal display panel for improving uniformity of a MPRT performance.

FIG. 5 illustrates data write and turn-on times and turn-off times of light sources for improving the MPRT performance. FIG. 6 illustrates a result of varying a modulation width of unit frame data depending on a display location on the liquid crystal display panel for improving uniformity of the MPRT performance.

As shown in FIG. 5, the liquid crystal display according to the exemplary embodiment of the invention controls the data driving circuit and the gate driving circuit using the sub-frame frequency of (unit frame frequency×N) Hz to thereby time-division drive the unit frame period into a first sub-frame period SF1 and a second sub-frame period SF2. The liquid crystal display displays the same modulation data R'G'B' on the liquid crystal display panel 10 during the first and second sub-frame periods SF1 and SF2. In this case, the light sources remain in a turn-off state during the first sub-frame period SF1 and then are turned on within the second sub-frame period SF2. The liquid crystal display according to the exemplary embodiment of the invention can have the improvement effect of the MPRAT described later through only the above-described drive.

As shown in FIG. 6, saturation time of the liquid crystals LC is delayed as the liquid crystals LC go from the top to the bottom of the liquid crystal display panel 10 in conformity with the scanning order of the liquid crystal display panel 10. The turn-on time of the light sources is determined based on time at which the liquid crystals LC in the middle portion of the liquid crystal display panel 10 are saturated, so as to reduce a difference between the saturation time of the liquid crystals LC and the turn-on time of the light sources throughout the entire area of the liquid crystal display panel 10. Because the exemplary embodiment of the invention multiplies the unit frame frequency by N and repeatedly applies the same data during the unit frame period, time required to saturate the liquid crystals LC can be reduced. Further, after the liquid crystals LC are saturated, the liquid crystals LC can remain in a stable state. In the exemplary embodiment of the invention, when the light sources are turned on within the second sub-frame period SF2, the difference between the saturation time of the liquid crystals LC and the turn-on time of the light sources may be reduced throughout the entire area of the liquid crystal display panel 10. In this case, the MPRT performance in the middle portion of the liquid crystal display panel 10 is very excellent, but the MPRT performance in upper and lower portions of the liquid crystal display panel 10 is worse than the MPRT performance in the middle portion of the liquid crystal display panel 10. The exemplary embodiment of the invention varies a modulation width of the unit frame data RGB depending on a display location of the unit frame data RGB on the liquid crystal display panel 10 so as to improve the uniformity of the MPRT performance. In other words, the exemplary embodiment of the invention increases the modulation width of the unit frame data RGB as a distance between the display location of the unit frame data RGB on the liquid crystal display panel 10 and a middle portion of the liquid crystal display panel 10 increases. Hence, a respond time of liquid crystals in the upper and lower portions of the liquid crystal display panel 10 is greater than a respond time of liquid crystals in the middle portion of the liquid crystal display panel 10. As a result, although turn-on time of the light sources is set based on saturation time of the liquid crystals LC in the middle portion of the liquid crystal display panel 10, the difference between the saturation time of the liquid crystals LC and the turn-on time of the light sources may be greatly reduced throughout the entire area of the liquid crystal display panel 10. Accordingly, the uniformity of the MPRT performance is greatly improved. The turn-on time of the light sources may be determined within the second sub-frame period SF2 after all of the liquid crystals LC of the liquid crystal display panel 10 are saturated.

Figure 7:
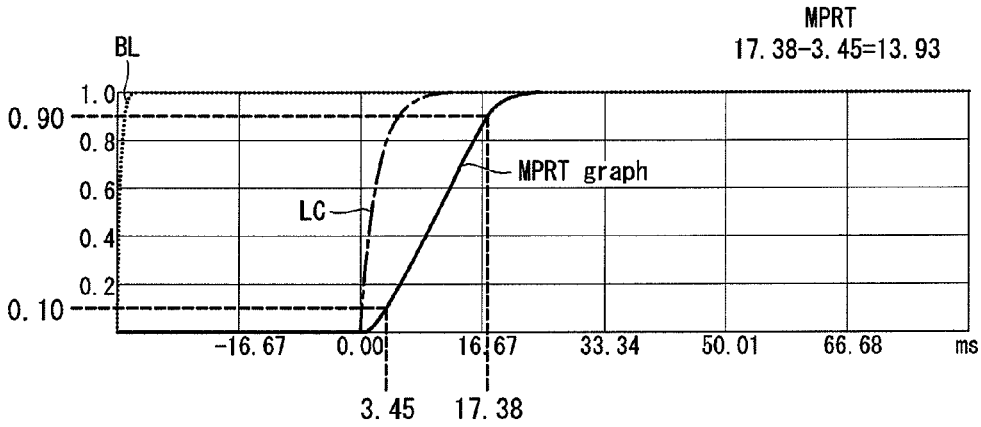
FIGS. 7(A) & 7(B) illustrate a simulation result showing an improvement of a MPRT performance, compared with a related art.
Figure 7:
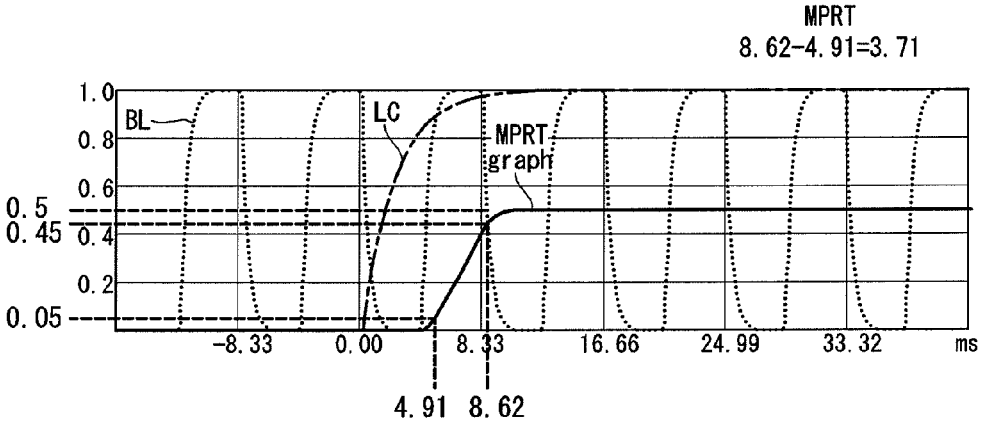

FIG. 7 illustrates a simulation result showing an improvement of the MPRT performance, compared with a related art. In FIGS. 7(A) and 7(B), a horizontal axis indicates time and a vertical axis indicates a normalized luminance value. More specifically, FIG. 7(A) illustrates a related art drive when the frame frequency is set to 60 Hz and the duty ratio of the PWM signal is set to 100%. FIG. 7(B) illustrates an exemplary time-division drive according to the embodiment of the invention during two sub-frame periods when the unit frame frequency is set to 120 Hz and the maximum duty ratio of the PWM signal is set to 50%.

As shown in FIG. 7(A), when a gray level of a display image changes from a first gray level (for example, a black gray level) to a second gray level (for example, a white gray level) by driving the liquid crystals LC and turning on the light sources BL at the duty ratio of 100%, the luminance of the display panel gradually changes to a first target luminance value (1.0) so as to achieve the second gray level. In FIG. 7(A), a MPRT value indicates a response time until the luminance of the display panel reaches from 10% (i.e., (0.2)) to 90% (i.e., (0.9)) of the first target luminance value (1.0). The MPRT value is 13.93 ms (i.e., 17.38 ms-3.45 ms).

On the other hand, as shown in FIG. 7(B), when a gray level of a display image changes from the first gray level (for example, the black gray level) to the second gray level (for example, the white gray level) by driving the liquid crystals LC and turning on the light sources BL at the duty ratio of 50%, the luminance of the display panel gradually changes to a second target luminance value (0.5) so as to achieve the second gray level. In FIG. 7(B), a MPRT value indicates a response time until the luminance of the display panel reaches from 10% (i.e., (0.05)) to 90% (i.e., (0.45)) of the second target luminance value (0.5). The MPRT value is 3.71 ms (i.e., 8.62 ms-4.91 ms). Because the turn-on duty ratio of the light sources BL in FIG. 7(B) is 50%, the second target luminance value (0.5) corresponds to one half of the first target luminance value (1.0).

As can be seen from FIG. 7(B), the embodiment of the invention can greatly reduce the MPRT value, compared with the related art illustrated in FIG. 7(A), thereby greatly improving the MPRT performance.

FIGS. 8 to 12 illustrate a configuration and an operation of the light source control circuit 14 for improving the uniformity of the MPRT performance.

Figure 8:
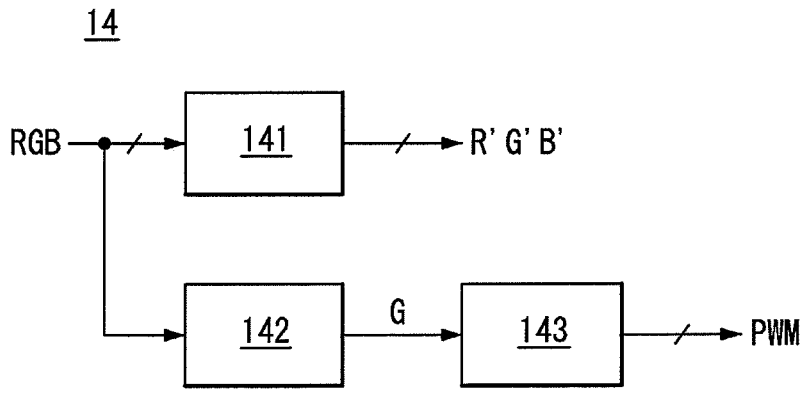
FIGS. 8 to 12 illustrate a configuration and an operation of a light source control circuit for improving uniformity of a MPRT performance according to the exemplary embodiment of the invention.

As shown in FIG. 8, the light source control circuit 14 includes a data modulation unit 141, a gain value calculation unit 142, and a duty ratio adjusting unit 143.

The data modulation unit 141 modulates the unit frame data RGB, and more particularly varies the modulation width of the unit frame data RGB depending on the display location of the unit frame data RGB on the liquid crystal display panel 10. The data modulation unit 141 divides the liquid crystal display panel 10 in a plurality of blocks along a longitudinal direction. The data modulation unit 141 increases the modulation width of the unit frame data RGB as a distance between the display location of the unit frame data RGB on the liquid crystal display panel 10 and a middle block of the plurality of blocks increases. Further, when an upper block and a lower block are spaced apart from the middle block by the same distance, the data modulation unit 141 allows the modulation width of the unit frame data RGB in the upper block and the modulation width of the unit frame data RGB in the lower block to be equal each other.

Figure 9:
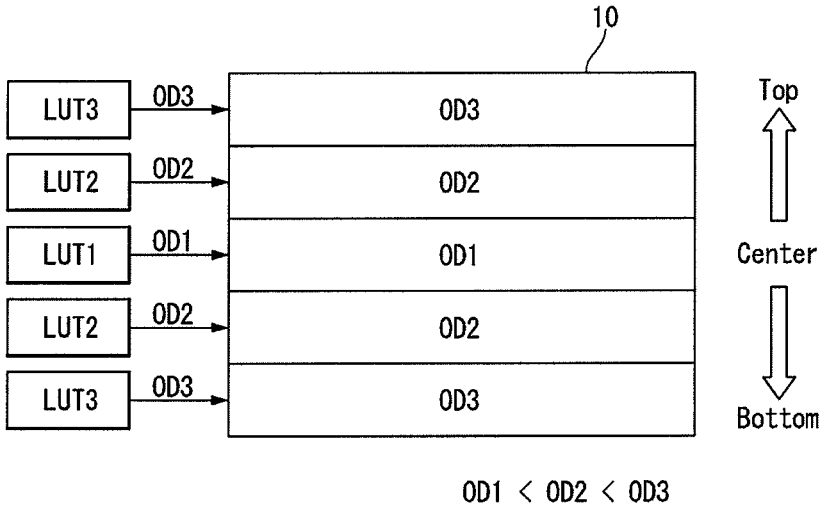

For this, as shown in FIG. 9, when the liquid crystal display panel 10 is divided into 5 blocks, the data modulation unit 141 may be implemented as follows. The data modulation unit 141 may include a first lookup table LUT1 for modulating the modulation width of the unit frame data RGB to be displayed on the middle block into a first modulation width OD1, a second lookup table LUT2 for modulating the modulation width of the unit frame data RGB to be displayed on each of an upper block and a lower block, that are spaced apart from the middle block by a first distance, into a second modulation width OD2 greater than the first modulation width OD1, and a third lookup table LUT3 for modulating the modulation width of the unit frame data RGB to be displayed on each of an upper block and a lower block, that are spaced apart from the middle block by a second distance longer than the first distance, into a third modulation width OD3 greater than the second modulation width OD2.

Figure 10:
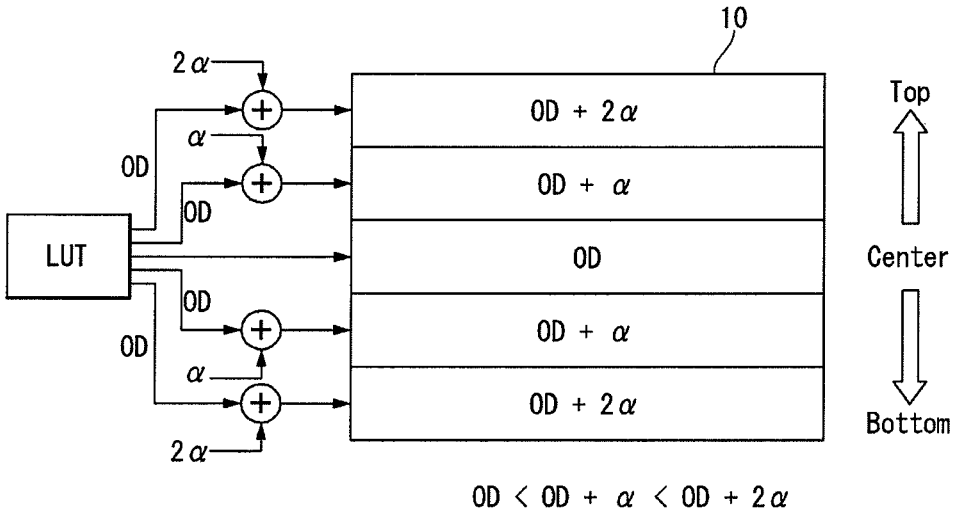

Further, as shown in FIG. 10, when the liquid crystal display panel 10 is divided into 5 blocks, the data modulation unit 141 may be implemented as follows. The data modulation unit 141 may include a lookup table LUT for modulating the modulation width of the unit frame data RGB to be displayed on the middle block into a first modulation width OD, a first adding unit for adding an output of the lookup table LUT to a first weight value a so as to modulate the modulation width of the unit frame data RGB to be displayed on each of an upper block and a lower block, that are spaced apart from the middle block by a first distance, into a second modulation width (OD+$\alpha$) greater than the first modulation width OD, and a second adding unit for adding the output of the lookup table LUT to a second weight value 2$\alpha$ greater than the first weight value a so as to modulate the modulation width of the unit frame data RGB to be displayed on each of an upper block and a lower block, that are spaced apart from the middle block by a second distance longer than the first distance, into a third modulation width (OD+2$\alpha$) greater than the second modulation width (OD+$\alpha$).

The gain value calculation unit 142 analyzes the unit frame data RGB to obtain a frame representative value. The gain value calculation unit 142 calculates a gain value G in each screen or in each predetermined area based on the frame representative value and supplies the gain value G to the duty adjusting unit 143. The gain value G may increase as the frame representative value increases, and may decrease increase as the frame representative value decreases.

Figure 11:
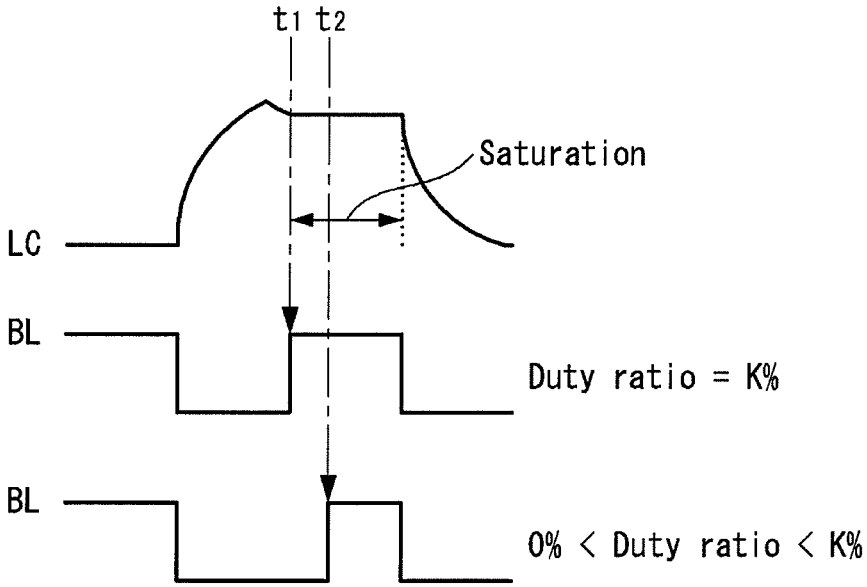

The duty adjusting unit 143 adjusts a duty ratio of the PWM signal depending on the gain value G received from the gain value calculation unit 142. The duty ratio of the PWM signal may be determined to be proportional to the gain value G within a range equal to or less than the previously set maximum duty ratio of 50%. The duty adjusting unit 143 may adjust turn-on time of the light sources to thereby adjust the duty ratio of the PWM signal. For example, as shown in FIG. 11, the duty adjusting unit 143 may adjust turn-on time of the light sources at a first time point t1 so as to achieve a duty ratio K % (K≦50) and may adjust turn-on time of the light sources at a second time point t2 so as to achieve a duty ratio less than the duty ratio K %.

As described above, the liquid crystal display according to the exemplary embodiment of the invention controls the operations of the driving circuits using the sub-frame frequency greater than the unit frame frequency and divides the unit frame period into the first and second sub-frame periods to repeatedly display the same data to the driving circuits during the first and second sub-frame periods. Further, the liquid crystal display according to the exemplary embodiment of the invention turns off all of the light sources during the first sub-frame period and turns on all of the light sources at the turn-on time within the second sub-frame period. Hence, the driving current of the light sources increases by the reduced turn-on time of the light sources in the unit frame period. Further, the liquid crystal display according to the exemplary embodiment of the invention increases the modulation width of the unit frame data as the unit frame data goes from the middle portion of the liquid crystal display panel to the upper and lower portions of the liquid crystal display panel. Hence, a respond time of liquid crystals in the upper and lower portions of the liquid crystal display panel is greater than a respond time of liquid crystals in the middle portion of the liquid crystal display panel. As a result, the liquid crystal display according to the exemplary embodiment of the invention can greatly improve the MPRT performance and the uniformity of MPRT using the blinking manner without the luminance reduction or without light interference resulting from the difference between turn-on time and turn-off time of the light sources.

Furthermore, because the liquid crystal display according to the exemplary embodiment of the invention drives the light sources in the blinking manner so as to improve the MPRT performance, the edge-type backlight unit may be used. The edge-type backlight unit is advantageous because it may be implemented to be thinner than the direct-type backlight unit requiring a sufficient distance between the light sources and the diffusion plate. As a result, the thin-profile of the liquid crystal display according to the exemplary embodiment of the invention can be easily achieved.

It will be apparent to those skilled in the art that various modifications and variations can be made in the liquid crystal display and method for driving the same of the invention without departing from the spirit or scope of the invention. Thus, it is intended that the invention cover the modifications and variations of this invention provided they come within the scope of the appended claims and their equivalents.

What is claimed is:

1. A liquid crystal display, comprising:

a liquid crystal display panel including data lines and gate lines;

a data driving circuit configured to drive the data lines;

a gate driving circuit configured to drive the gate lines;

a plurality of light sources configured to provide light to the liquid crystal display panel;

a light source control circuit configured to differently modulate a unit frame data depending on a display location of the unit frame data on the liquid crystal display panel and to control turn-on and turn-off operations of the plurality of light sources;

a timing controller configured to divide a unit frame period into a first sub-frame period and a second sub-frame period and to repeatedly supply the modulated unit frame data to the data driving circuit during the first and second sub-frame periods; and a light source driving circuit configured to turn off all the plurality of light sources during the first sub-frame period and turn on all the plurality of light sources at a turn-on time within the second sub-frame period, wherein the light source control circuit includes a data modulation unit configured to divide the liquid crystal display panel in a plurality of blocks along a longitudinal direction and increase the modulation width of the unit frame data as a distance between the display location of the unit frame data on the liquid crystal display panel and a middle block of the plurality of blocks increases.

2. The liquid crystal display of claim 1, wherein the timing controller multiplies a unit frame frequency by N and controls an operation timing of the data driving circuit and an operation timing of the gate driving circuit using a sub-frame frequency of (unit frame frequency×N), where N is a positive integer equal to or greater than 2.

3. The liquid crystal display of claim 1, wherein the light source control circuit generates a pulse width modulation (PWM) signal for controlling the turn-on and turn-off operations of the light sources and a current control signal for controlling a driving current applied to the light sources.

4. The liquid crystal display of claim 3, wherein the light source control circuit includes:

a gain value calculation unit configured to analyze the unit frame data to obtain a frame representative value and to calculate a gain value based on the frame representative value; and a duty adjusting unit configured to adjust a duty ratio of the PWM signal depending on the gain value, wherein the duty ratio of the PWM signal is adjusted to be proportional to the gain value within a range equal to or less than a previously set maximum duty ratio.

5. The liquid crystal display of claim 4, wherein a level of the driving current is previously set to be inversely proportional to a maximum duty ratio of the PWM signal.

6. The liquid crystal display of claim 4, wherein the frame representative value is calculated based on an entire screen of the liquid crystal display panel or based on each block of the liquid crystal display panel smaller than the entire screen, wherein the duty ratio of the PWM signal is adjusted based on the entire screen of the liquid crystal display panel or based on each block of the liquid crystal display panel smaller than the entire screen.

7. The liquid crystal display of claim 1, wherein when an upper block and a lower block of the plurality of blocks are spaced apart from the middle block by the same distance, the data modulation unit allows a modulation width of the unit frame data in the upper block and a modulation width of the unit frame data in the lower block to be equal each other.

8. The liquid crystal display of claim 7, wherein the data modulation unit includes:

a first lookup table configured to modulate the modulation width of the unit frame data to be displayed on the middle block into a first modulation width;

a second lookup table configured to modulate the modulation width of the unit frame data to be displayed on each of a first upper block and a first lower block, that are spaced apart from the middle block by a first distance, into a second modulation width greater than the first modulation width; and a third lookup table configured to modulate the modulation width of the unit frame data to be displayed on each of a second upper block and a second lower block, that are spaced apart from the middle block by a second distance longer than the first distance, into a third modulation width greater than the second modulation width.

9. The liquid crystal display of claim 7, wherein the data modulation unit includes:

a lookup table configured to modulate the modulation width of the unit frame data to be displayed on the middle block into a first modulation width;

a first adding unit configured to add an output of the lookup table to a first weight value so as to modulate the modulation width of the unit frame data to be displayed on each of a first upper block and a first lower block, that are spaced apart from the middle block by a first distance, into a second modulation width greater than the first modulation width; and a second adding unit configured to add the output of the lookup table to a second weight value greater than the first weight value so as to modulate the modulation width of the unit frame data to be displayed on each of a second upper block and a second lower block, that are spaced apart from the middle block by a second distance longer than the first distance, into a third modulation width greater than the second modulation width.

10. The liquid crystal display of claim 1, wherein the turn-on time of the light sources is determined within the second sub-frame period after all of liquid crystals of the liquid crystal display panel are saturated.

* * * * *